US009194105B2

(12) United States Patent
Kurushima

(10) Patent No.: US 9,194,105 B2
(45) Date of Patent: Nov. 24, 2015

(54) CONSTRUCTION MACHINE

(71) Applicant: KOBELCO CONSTRUCTION MACHINERY CO., LTD., Hiroshima-shi (JP)

(72) Inventor: Satoshi Kurushima, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 14/287,676

(22) Filed: May 27, 2014

(65) Prior Publication Data

US 2014/0360354 A1 Dec. 11, 2014

(30) Foreign Application Priority Data

Jun. 7, 2013 (JP) ..... 2013-120547

(51) Int. Cl.
*E02F 9/08* (2006.01)
*E02F 9/20* (2006.01)
*E02F 9/22* (2006.01)

(52) U.S. Cl.
CPC ..... *E02F 9/2012* (2013.01); *E02F 9/0875* (2013.01); *E02F 9/2275* (2013.01)

(58) Field of Classification Search
CPC ..... E02F 9/0875; E02F 9/2275
USPC ..... 180/89.12
See application file for complete search history.

(56) References Cited

U.S. PATENT DOCUMENTS

| | | | | |
|---|---|---|---|---|
| 8,967,309 | B2 * | 3/2015 | Kimura et al. | 180/68.1 |
| 2008/0005937 | A1 | 1/2008 | Nakayoshi et al. | |
| 2008/0035401 | A1 | 2/2008 | Ishii et al. | |
| 2014/0003901 | A1 * | 1/2014 | Takagi et al. | 414/687 |
| 2014/0186151 | A1 * | 7/2014 | Ootsuka et al. | 414/685 |

FOREIGN PATENT DOCUMENTS

| | | | |
|---|---|---|---|
| JP | 8-74292 | A | 3/1996 |
| JP | 2000-96626 | A | 4/2000 |
| JP | 2000-213003 | A | 8/2000 |

(Continued)

OTHER PUBLICATIONS

Extended European Search Report issued Oct. 20, 2014 in Patent Application No. 14170719.0.

(Continued)

*Primary Examiner* — Ruth Ilan
(74) *Attorney, Agent, or Firm* — Oblon, McClelland, Maier & Neustadt, L.L.P.

(57) ABSTRACT

Provided is a construction machine with valves and hoses whose routing operations are simplified. The construction machine includes an upper frame, a control valve assembly, remote control valves, an operation-pattern selector valve, remote control hoses, pilot hoses, and actuator hoses. The upper frame includes a bottom plate and a floor plate, allowing an operation seat to be provided on the upper frame. The control valve assembly and the operation-pattern selector valve are provided in an underfloor space between the bottom plate and the floor plate. A partition wall stands upright on the bottom plate at a rear side of the control valve assembly. The operation-pattern selector valve has a shaft and a handle connected thereto, disposed in such a horizontal posture that the shaft extends horizontally, at a front side of the control valve assembly as viewed from the operation seat.

4 Claims, 3 Drawing Sheets

(56) References Cited

FOREIGN PATENT DOCUMENTS

| | | | |
|---|---|---|---|
| JP | 2000-291065 | A | 10/2000 |
| JP | 2002-227249 | A | 8/2002 |
| JP | 2006-97341 | A | 4/2006 |
| JP | 2008-31817 | | 2/2008 |
| JP | 2012-17553 | | 1/2012 |

OTHER PUBLICATIONS

Office Action issued May 12, 2015 in Japanese Patent Application No. 2013-120547 (with partial English language translation).

* cited by examiner

CONSTRUCTION MACHINE

BACKGROUND OF THE INVENTION

1. Field of the Invention

The present invention relates to a construction machine such as a hydraulic excavator, the construction machine including a plurality of control valves, a plurality of remote control valves to operate the control valves respectively, and an operation-pattern selector valve to select one from combinations of the control valves and the remote control valves.

2. Description of the Background Art

The background art of the invention is described by an example of a small hydraulic excavator shown in FIG. 5.

The hydraulic excavator includes: a crawler-type lower travelling body 1; an upper slewing body 2 mounted on the lower travelling body 1 so as to be slewable around an axis X perpendicular to the ground; and a working attachment WA mounted on the front portion of the upper slewing body 2. The working attachment WA includes a boom 3, an arm 4, a bucket 5, and respective hydraulic actuators for operating the boom 3, the arm 4, and the bucket 5, namely, a boom cylinder 6, an arm cylinder 7, and a bucket cylinder 8.

The upper slewing body 2 includes an upper frame 9, on which an operation seat 10, a canopy 11, a control valve assembly 14, various operation devices, an engine, and relevant devices thereof are installed. The upper frame 9 includes a bottom plate 12 and a floor plate 13 as shown in FIG. 6. The floor plate 13 is disposed over the bottom plate 12 with a vertical distance.

The control valve assembly 14 is an assembly of multiple control valves, which are constituted of hydraulically-pilot-operated selector valves configured to individually control respective actuations of the hydraulic actuators, as described in Japanese Unexamined Patent Publication No. 2012-17553. In the specification, front and rear directions, and left and right directions are directions as viewed from the operator seated on the operation seat 10.

The control valve assembly 14 is mounted on the upper frame bottom plate 12 via a valve mounting member 15. The control valves are operated by the remote control valves 16, respectively. The remote control valves 16 are disposed around the operation seat 10 as shown in FIG. 6 by the two dotted chain line.

The operation-pattern selector valve 17 is a valve for an operator to select an operation pattern which is a pattern of respective combinations of the control valves and the remote control valves 16 in accordance with the operator's intention. The operation-pattern selector valve 17 is constituted of, e.g., a rotary selector valve (typically, called as "multiple valve"), including a tubular body 18, a shaft 19 held in the body 18 rotatably around the axis of the shaft 19, an operation handle 20 extending horizontally from the upper end of the shaft 19. A rotational operation is applied to the handle 20 to select one from a plurality of operation patterns.

As shown in FIG. 6, the operation-pattern selector valve 17 is mounted on the upper-frame bottom plate 12 through a bracket 21, similarly to one disclosed in, e.g., Japanese Unexamined Patent Publication No. 2008-31817, in a rear side of the control valve assembly 14 in such a vertical posture that the shaft 19 extends vertically and the handle 20 is located at the upper end of the shaft 19. Similarly, on the upper frame bottom plate 12 is provided a partition wall 22 so as to stand upright. The partition wall 22 partitions the space over the upper frame bottom plate 12 at a rear side of an underfloor space S, i.e., immediately behind the operation-pattern selector valve 17, thereby defining an engine room 23 under the operation seat 10.

There are respective hydraulic interconnections of: each of the remote control valves 16 and the operation-pattern selector valve 17; the operation-pattern selector valve 17 and each of the control valves of the control valve assembly 14; and each of the control valves of the control valve assembly 14 and each of the hydraulic actuators, through respective hoses. Specifically, as shown in FIG. 6 by the two dotted chain lines, each of the remote control valves 16 and the operation-pattern selector valve 17 are connected to each other through respective remote control hoses H1; the operation-pattern selector valve 17 and each of the control valves of the control valve assembly 14 are connected to each other through respective pilot hoses H2; and each of the control valves of the control valve assembly 14 and each of the hydraulic actuators are connected to each other by respective actuator hoses H3.

As to this type of arrangement, according to the conventional art disclosed in Japanese Unexamined Patent Publication No. 2008-31817, the operation-pattern selector valve 17 should be disposed in an upright posture at a rear side of the control valve assembly 14 and the handle 20 should be located at an upper position of the control valve assembly 14; the hose routing is therefore cumbersome.

Specifically, the arrangement of the operation-pattern selector valve 17 at a rear side of the control valve assembly 14, for instance, the arrangement of the operation-pattern selector valve 17 at an immediately front side of the partition wall 22 which is the rear limit of the underfloor space S, as shown in FIG. 6, requires for bending the remote control hose H1 suspending from the remote control valve 16 at a substantially right angle in a small clearance between the partition wall 22 and the operation-pattern selector valve 17 and connecting the remote control hose H1 to the operation-pattern selector valve 17 at the bent portion. This may decreases the flexibility in handling the remote control hose H1. Besides, the bending operation of the remote control hose H1 and the connection operation of the remote control hose H1 are cumbersome.

Furthermore, disposition of the operation-pattern selector valve 17 in the upright posture involves circuitously routing the actuator hose H3 as shown in FIG. 6, specifically, connecting one end of the actuator hose H3 to the control valve assembly 14 while guiding the other end thereof to each of the hydraulic actuators passing through the positions near the center of slewing. The actuator hose H3 is, therefore, required to be routed so as to pass through the small clearance between the operation-pattern selector valve 17 and the floor plate 13 while keeping away from the handle 20. In another alternative, the actuator hose H3 could be routed so as to pass not through the above clearance but beside the operation-pattern selector valve 17; however, this may involve interference of the actuator hose H3 with the pilot hose H2.

SUMMARY OF THE INVENTION

An object of the invention is to provide a construction machine with a plurality of valves and hoses for respective connections of the valves, the construction machine allowing the hoses to be easily routed.

Provided by the invention is a construction machine including: a lower travelling body; an upper slewing body mounted on the lower travelling body to be slewable around a vertical axis; a plurality of hydraulic actuators; a control valve assembly which is an assembly of a plurality of control valves configured to control respective actuations of the hydraulic actuators; a plurality of remote control valves for operating the control valves; an operation-pattern selector valve for selecting an operation pattern of respective combinations between the remote control valves and the control valves; a plurality of remote control hoses which connect the remote control valves to the operation-pattern selector valve, respectively; a plurality of pilot hoses which connect the control valves to the operation-pattern selector valve, respectively; and a plurality of actuator hoses which connect the control valves to the hydraulic actuators, respectively. The upper slewing body includes an upper frame, which includes a bottom plate, and a floor plate on which an operation seat is provided, the upper frame disposed over the bottom plate with a distance. The control valve assembly and the operation-pattern selector valve are disposed in an underfloor space between the bottom plate and the floor plate. A partition wall stands upright on the bottom plate at a rear side of the control valve assembly. The operation-pattern selector valve includes a tubular body, a shaft held in the body rotatably around an axis of the shaft, and a handle for selection operation, the handle extending from one end of the shaft orthogonally to the axis of the shaft. The operation-pattern selector valve is disposed, at a front side of the control valve assembly as viewed from an operator seated on the operation seat, in such a horizontal posture that the shaft extends horizontally.

These and other objects, features and advantages of the present invention will become more apparent upon reading the following detailed description along with the accompanying drawings.

DESCRIPTION OF THE PREFERRED EMBODIMENT

Figure 5:
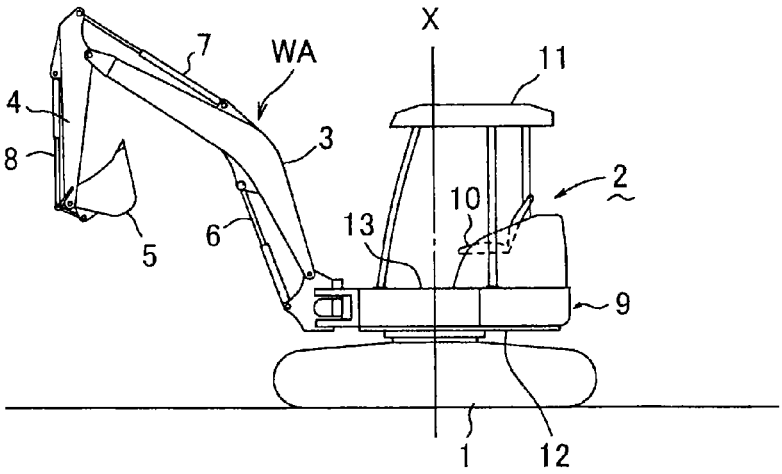
FIG.5 PRIOR ART
FIG. 5 is a schematic side view of the hydraulic excavator.
Figure 6:
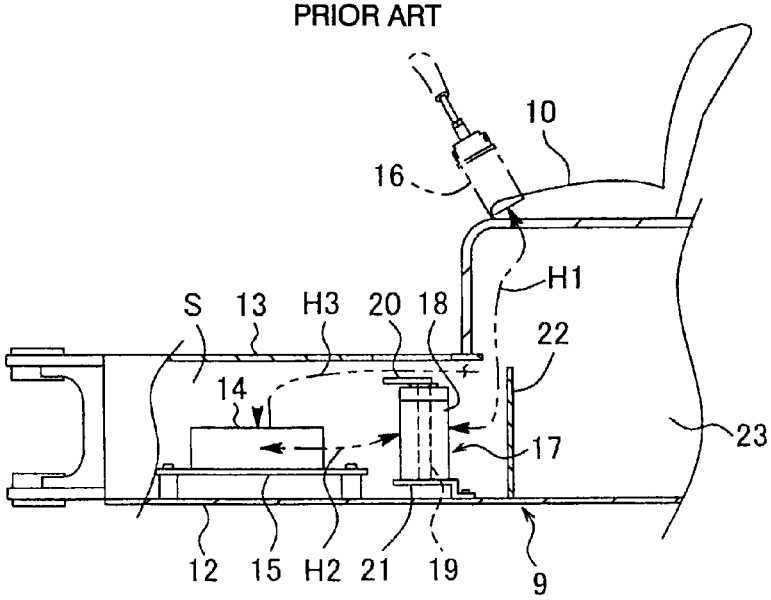
FIG.6 PRIOR ART
FIG. 6 is a partially enlarged sectional side view of the hydraulic excavator shown in FIG. 5.

An embodiment of the invention is described referring to the drawings. The embodiment is an example, in which the invention is applied to a compact type of excavator shown in FIG. 5. Specifically, the hydraulic excavator according to the embodiment includes: a crawler-type lower travelling body 1; an upper slewing body 2 mounted on the lower travelling body 1 so as to be slewable around an axis X perpendicular to the ground; and a working attachment WA mounted on the front portion of the upper slewing body 2. The working attachment WA includes a boom 3, an arm 4, a bucket 5, and respective hydraulic actuators for operating the boom 3, the arm 4, and the bucket 5, namely, a boom cylinder 6, an arm cylinder 7, and a bucket cylinder 8. The upper slewing body 2 includes an upper frame 9, on which an operation seat 10, a canopy 11, various operation devices, an engine, and relevant devices thereof are installed. The upper frame 9 includes a bottom plate 12 and a floor plate 13 as shown in FIG. 6. The floor plate 13 is disposed over the bottom plate 12 with a vertical distance.

Figure 1:
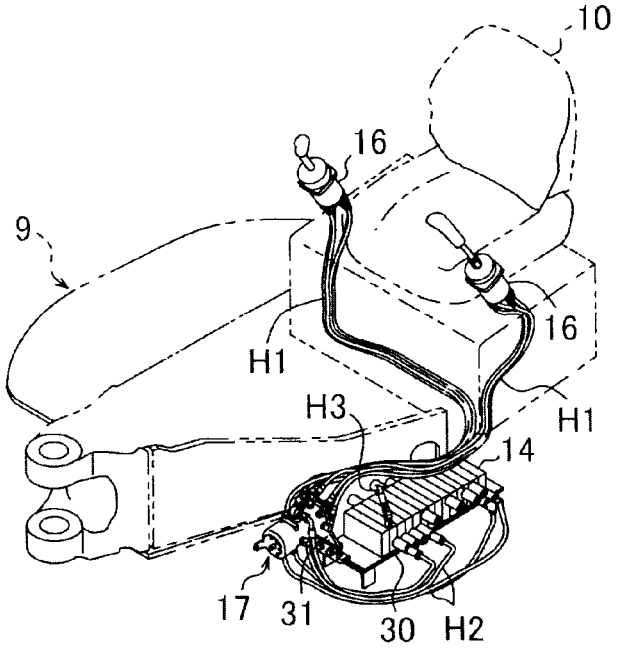
FIG. 1 is a perspective view of essential parts of a hydraulic excavator according to an embodiment of the invention.

The control valve assembly 14 is an assembly of multiple control valves, which are constituted of hydraulically-pilot-operated selector valves configured to individually control respective actuations of the hydraulic actuators. The control valve assembly 14 is mounted on the upper frame bottom plate 12 via a valve mounting member 30. The control valves are operated by the remote control valves 16, respectively. The remote control valves 16 are disposed around the operation seat 10 as shown in FIG. 1.

The operation-pattern selector valve 17 is a valve for an operator to select an operation pattern which is a pattern of respective combinations of the control valves and the remote control valves 16 in accordance with the operator's intention. The operation-pattern selector valve 17 is constituted of, e.g., a rotary selector valve (typically, called as "multiple valve"), including a tubular body 18, a shaft 19 held in the body 18 rotatably around the axis of the shaft 19, an operation handle 20 extending horizontally from the upper end of the shaft 19. A rotational operation is applied to the handle 20 to select one from a plurality of operation patterns.

Figure 2:
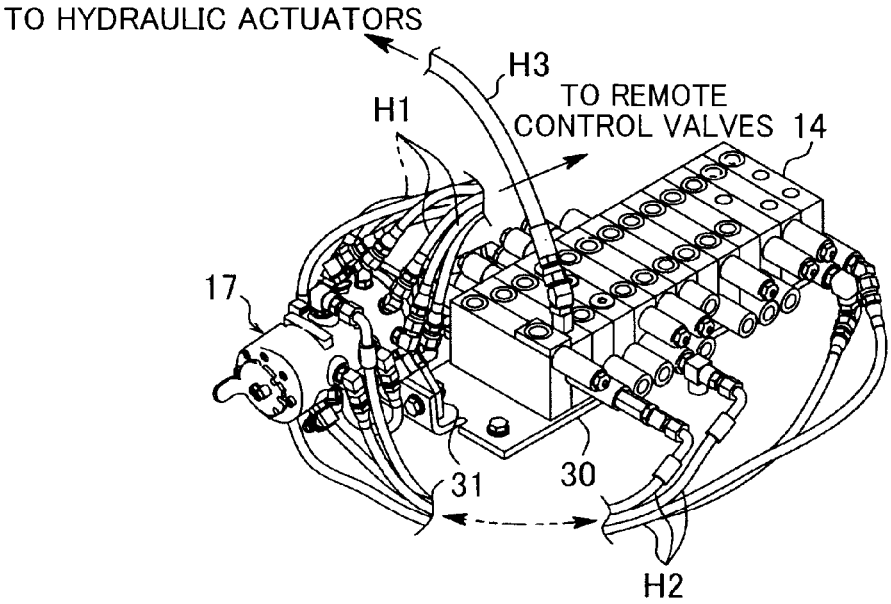
FIG. 2 is an enlarged perspective view showing a control valve assembly, an operation-pattern selector valve, and hoses connected to the control valve assembly and to the operation-pattern selector valve shown in FIG. 1.

There are respective hydraulic interconnections of: each of the remote control valves 16 and the operation-pattern selector valve 17; the operation-pattern selector valve 17 and each of the control valves of the control valve assembly 14; and each of the control valves of the control valve assembly 14 and each of the hydraulic actuators, through respective hoses. Specifically, each of the remote control valves 16 and the operation-pattern selector valve 17 are connected to each other through a plurality of remote control hoses H1, respectively; the operation-pattern selector valve 17 and the control valves of the control valve assembly 14 are connected to each other through a plurality of pilot hoses H2, respectively; and each of the control valves of the control valve assembly 14 and each of the hydraulic actuators are connected to each other by a plurality of actuator hoses H3, respectively. In FIG. 2 and in FIG. 3, only one of the actuator hoses H3 is shown in order to avoid complication of the illustration.

Figure 4:
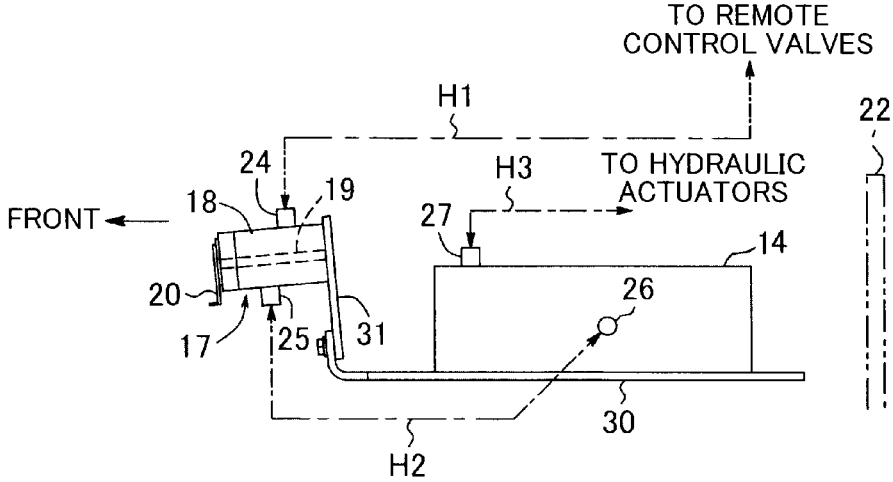
FIG. 4 is a side view schematically showing disposition of the control valve assembly and the operation-pattern selector valve, and a routing condition of each hose.

The operation-pattern selector valve 17 according to the embodiment is disposed at a front side of the control valve assembly 14. The operation-pattern selector valve 17 is disposed in such a horizontal posture that the shaft 19 extending horizontally. The handle 20 is located at a front end of the shaft 19. As shown in FIG. 4, the operation-pattern selector valve 17 includes a plurality of remote-control-hose connection ports 24 to which the remote control hoses H1 are connected, respectively. Each of the remote control hose connection ports 24 is disposed higher than the upper surface of the control valve assembly 14.

As shown in FIG. 4, the operation-pattern selector valve 17 includes a plurality of pilot-hose-connection ports 25 to which the pilot hoses H2 are connected, respectively. The control valve assembly 14 includes a plurality of pilot-hose connection ports 26 to which the pilot hoses H2 are connected, respectively, and a plurality of actuator-hose connection ports 27 to which the actuator hoses H3 are connected, respectively.

Figure 3:
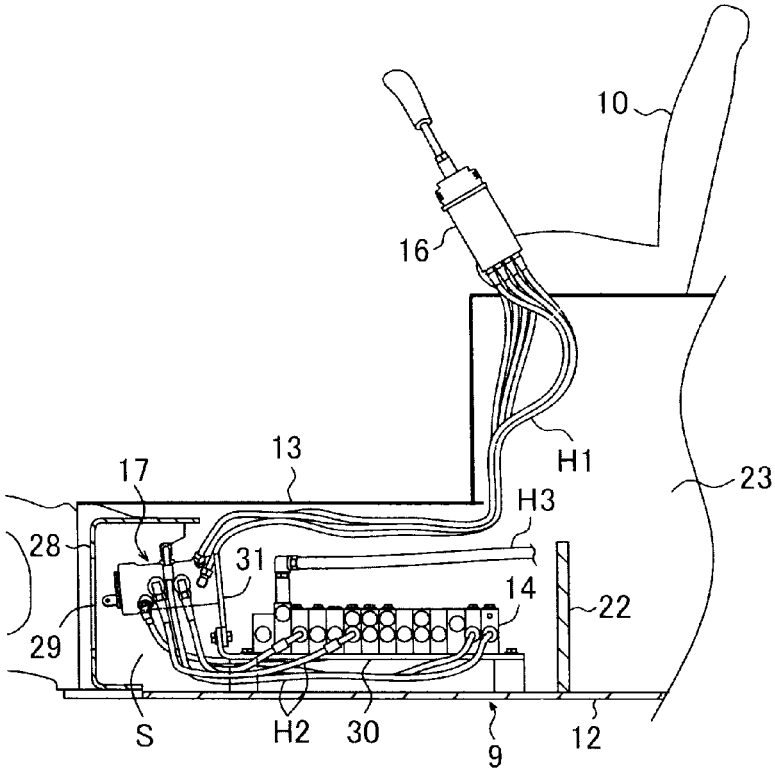
FIG. 3 is a partially sectional side view of the hydraulic excavator.

As shown in FIG. 3, a partition wall 22 and a front cover 28 stand upright on the upper frame bottom plate 12. The partition wall 22 partitions the space over the upper frame bottom plate 12 at a rear side of the underfloor space S, i.e., at an immediately rear side of the operation-pattern selector valve 17 to thereby define an engine room 23 under the operation seat 10. The front cover 28 is provided at such a position as to close the front side of the underfloor space S. The front cover 28 includes an operation opening 29 through which the handle 20 of the operation-pattern selector valve 17 is opened forward so as to allow the operator to operate the handle 20 from the front side.

The operation-pattern selector valve 17 is mounted, via a bracket 31, on a valve mounting member 30 on which the control valve assembly 14 is mounted. The bracket 31 has, for example, a flat-plate shape standing substantially upright. The bracket 31 has a lower end, which is connected to the front end of the valve mounting member 30, and an upper portion, to which the operation-pattern selector valve 17 is fixed. In other words, the control valve assembly 14 and the operation pattern switching valve 17 are mounted on the common valve mounting member 30, thus constituting a single valve unit.

The hoses H1, H2, and H3 are routed so as to pass around the control valve assembly 14 while locating the pilot hoses H2 lower than the hoses H1 and H3, locating the remote control hose H1 higher than the hoses H2 and H3, and locating the actuator hose H3 intermediately between the hoses H2 and H1.

The operation-pattern selector valve 17 in the present embodiment is located at a front side of the control valve assembly 14, thus inhibiting the partition wall 22 from obstructing the routing and the connection of the remote control hoses H1. Besides, the operation-pattern selector valve 17, being disposed in such a horizontal posture that the shaft 19 extends horizontally, allows respective vertically large spaces for routing and connection to be secured. Moreover, the handle 20 is not likely to obstruct the routing of the hoses.

Furthermore, the operation-pattern selector valve 17, being disposed in a horizontal posture so as to locate the remote-control-hose connection ports 24 of the operation-pattern selector valve 17 higher than the upper surface of the control valve assembly 14, enables the remote control hoses H1 to be routed far away from the other hoses, i.e., the pilot hoses H2 and the actuator hoses H3.

In addition, the handle 20 of the operation-pattern selector valve 17, being located at the front end of the shaft 19 of the operation-pattern selector valve 17, can be located at a front side of all of the hoses H1, H2, and H3, which prevents the handle 20 from interference with the hoses H1, H2, H3. This allows the routing operation of the hoses H1 to H3 to be more simplified.

The above-described arrangements enables the operations of routing the hoses H1, H2, and H3 including bending and connection thereof to be greatly simplified, as compared with the conventional art.

On the other hand, mounting the control valve assembly 14 and the operation-pattern selector valve 17 on the common valve mounting member 30 allows so called a sub-assembly to be performed. Specifically, prior to installing the control valve assembly 14 and the operation-pattern selector valve 17 on the upper frame 9, the following operations are allowed to be previously performed: a) operations of mounting the control valve assembly 14 and the operation-pattern selector valve 17 on the valve mounting member 30 to thereby integrate them into one unit; b) operations of connecting the pilot hoses H2 to the control valve assembly 14 and the operation-pattern selector valve 17, respectively; c) operations of connecting respective one ends of the remote control hoses H1 to the operation-pattern selector valve 17; and d) operations of connecting respective one ends of the actuator hose H3 to the control valve assembly 14. This allows the operations of mounting the above elements, including routing operations thereof, to be extremely simplified.

Furthermore, the hoses H1, H2, and H3 are routed so as to pass around the control valve assembly 14 such that: the pilot hoses H2 are located lower than the hoses H1 and H3; the remote control hoses H1 are located higher than the hoses H2 and H3; and the actuator hoses H3 are located intermediately between the hoses H2 and H1. In other words, the hoses H1, H2, and H3 are individually and independently routed without tangling. The operations of routing and maintenance of the hoses H1, H2, and H3, are thus allowed to be easily performed.

The invention is not limited to the embodiment, for example, including the following modifications.

(1) The operation-pattern selector valve 17 may be disposed in a horizontal posture of directing laterally in left and right directions or directing rearward. Regarding the horizontal posture, the expression "the shaft extends horizontally" intends not to exclude such a posture that the shaft is inclined vertically but to permit the shaft to be inclined with a slight inclination.

(2) The valve mounting member 30 and the bracket 31 may be integrally formed with each other. Alternatively, the control valve assembly 14 and the operation-pattern selector valve 17 may be individually and independently mounted on mounting members.

(3) The invention is not limited to a hydraulic excavator. The invention may be applied to other construction machines, such as a demolishing machine or a crusher as an applied excavator, including a control valve assembly, an operation-pattern selector valve, and a plurality of remote control valves, wherein the control valve assembly and the operation-pattern selector valve are provided in an underfloor space, as well as an excavator.

As described above, according to the invention, provided is a construction machine with a plurality of valves and hoses for respective connections of the valves, the construction machine allowing the hoses to be easily routed. The construction machine includes: a lower travelling body; an upper slewing body mounted on the lower travelling body to be slewable around a vertical axis; a plurality of hydraulic actuators; a control valve assembly which is an assembly of a plurality of control valves configured to control respective actuations of the hydraulic actuators; a plurality of remote control valves for operating the control valves; an operation-pattern selector valve for selecting an operation pattern of respective combinations between the remote control valves and the control valves; a plurality of remote control hoses which connect the remote control valves to the operation-pattern selector valve, respectively; a plurality of pilot hoses which connect the control valves to the operation-pattern selector valve, respectively; and a plurality of actuator hoses which connect the control valves to the hydraulic actuators, respectively. The upper slewing body includes an upper frame, which includes a bottom plate, and a floor plate on which an operation seat is provided, the upper frame disposed over the bottom plate with a distance. The control valve assembly and the operation-pattern selector valve are disposed in an underfloor space between the bottom plate and the floor plate. A partition wall stands upright on the bottom plate at a rear side of the control valve assembly. The operation-pattern selector valve includes a tubular body, a shaft held in the body rotatably around an axis of the shaft, and a handle for selection operation, the handle extending from one end of the shaft orthogonally to the axis of the shaft. The operation-pattern selector valve is disposed, at a front side of the control valve assembly as viewed from an operator seated on the operation seat, in such a horizontal posture that the shaft extends horizontally.

In this construction machine, where the operation-pattern selector valve is disposed at the front side of the control valve assembly, the partition wall is inhibited from obstructing operations of routing and connecting the remote control hoses. Besides, the operation-pattern selector valve disposed in a horizontal posture allows respective vertically large spaces for routing and connection to be secured and inhibit the handle from obstructing the routing operation. These matters enables the routing operation of each of the hoses including the bending and connection thereof to be markedly simplified, as compared with the conventional art disclosed in FIG. 6.

Preferably, the operation-pattern selector valve includes a plurality of remote-control-hose connection ports to which the remote control hoses are connected, respectively, and each of the remote-control-hose connection ports are disposed higher than an upper surface of the control valve assembly. This arrangement allows the remote control hoses to be routed far away from the other hoses, i.e., the actuator hoses and the pilot hoses, thereby allowing the hoses to be more easily routed with no interference of the hoses with each other.

The operation-pattern selector valve is preferably disposed so as to locate the handle at a front end of the shaft. This disposition enables the handle to be located at a front side of all of the hoses, thus preventing the handle from interference with the hoses to further simplify the routing operation.

The construction machine according to the invention, preferably, further includes a valve mounting member disposed on the bottom plate, wherein the control valve assembly and the operation-pattern selector valve are mounted on the common valve mounting member. The valve mounting member allows so called a sub-assembly to be performed, the sub-assembly being previously performing: a) operations of mounting the control valve assembly and the operation-pattern selector valve on the valve mounting member to thereby integrate them into one unit; b) operations of connecting the pilot hoses to the control valve assembly and the operation-pattern selector valve, respectively; c) operations of connecting respective one ends of the remote control hoses to the operation-pattern selector valve; and d) operations of connecting respective one ends of the actuator hose to the control valve assembly. This allows the operations of mounting the above elements, including routing operations thereof, to be extremely simplified.

As to the remote control hoses, the pilot hoses, and the actuator hoses, it is preferable that these hoses are routed so as to pass around the control valve assembly in a state that: the pilot hoses are located lower than either of the remote control hoses and the actuator hoses; the remote control hoses are located higher than the either of the pilot hoses and the actuator hoses; and the actuator hoses are located intermediately between the remote control hoses and the pilot hoses. The remote control hoses, the pilot hoses, and the actuator hoses are thus allowed to be routed individually and independently from each other without tangling, which allows the routing operation and the maintenance thereof to be easily performed.

This application is based on Japanese Patent Application No. 2013-120547 filed on Jun. 7, 2013, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A construction machine, comprising:

a lower travelling body;

an upper slewing body mounted on the lower travelling body to be slewable around a vertical axis, the upper slewing body including an upper frame, the upper frame including a bottom plate and a floor plate disposed over the bottom plate with a distance;

an operation seat being provided on the upper frame;

a plurality of hydraulic actuators;

a control valve assembly which is an assembly of control valves configured to control respective actuations of the hydraulic actuators, respectively, the control valve assembly being provided in an underfloor space between the bottom plate and the floor plate;

a plurality of remote control valves for operating the control valves, respectively;

an operation-pattern selector valve provided in the underfloor space for selecting an operation pattern of combinations between the remote control valves and the control valves, the operation-pattern selector valve including a tubular body, a shaft held in the body rotatably around an axis of the shaft, a handle for switching operation, the handle extending from one end of the shaft in a direction orthogonal to the axis of the shaft, and a plurality of remote-control-hose connection ports;

a partition wall provided to stand upright on the bottom plate at a rear side of the control valve assembly;

a plurality of remote control hoses which are connected to the respective remote-control-hose connection ports to connect the remote control valves to the operation-pattern selector valve, respectively;

a plurality of pilot hoses which connect the control valves to the operation-pattern selector valve, respectively; and a plurality of actuator hoses which connect the control valves to the hydraulic actuators, respectively;

a valve mounting member disposed on the bottom plate, the control valve assembly and the operation-pattern selector valve being commonly mounted to the valve mounting member;

a bracket having a lower end connected to the front end of the valve mounting member and an upper portion to which the operation-pattern selector valve is mounted, the operation-pattern selector valve being mounted to the valve mounting member via the bracket in a horizontal posture wherein the shaft extends horizontally, at a front side of the control valve assembly as viewed from an operator seated on the operation seat.

2. The construction machine according to claim 1, wherein the operation-pattern selector valve is disposed so as to locate the handle at a front end of the shaft, thus allowing the handle to be located at a front side of all of the remote control hoses, the pilot hoses and the actuator hoses.

3. The construction machine according to claim 1, wherein the remote control hoses, the pilot hoses, and the actuator hoses are routed so as to pass around the control valve assembly in a state that: the pilot hoses are located lower than the remote control hoses and the actuator hoses; the remote control hoses are located higher than the pilot hoses and the actuator hoses; and the actuator hoses are located intermediately between the remote control hoses and the pilot hoses.

4. The construction machine according to claim 1, wherein a front cover is provided to stand upright on the bottom plate to close the front side of the underfloor space and has an operation opening, and wherein the operation-pattern selector valve mounted in a horizontal posture is located such that the handle of the operation-pattern selector valve faces forwardly toward the operation opening.

* * * * *